United States Patent [19]

Willenbacher

[11] 4,376,415

[45] Mar. 15, 1983

[54] DEVICE FOR SEWING WORKPIECE PLIES TOGETHER IN CONTOUR ALIGNMENT

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 259,143

[22] Filed: Apr. 30, 1981

[30] Foreign Application Priority Data

Apr. 30, 1980 [DE] Fed. Rep. of Germany ..... 3016676

[51] Int. Cl.[3] ..... D05B 19/00; D05B 21/00

[52] U.S. Cl. ..... 112/121.11; 112/122; 112/130; 112/304; 112/308; 112/153

[58] Field of Search ..... 112/121.11, 121.12, 112/121.15, 122, 127, 130, 304, 308, 153

[56] References Cited

U.S. PATENT DOCUMENTS

| | | | |
|---|---|---|---|
| 1,197,112 | 9/1916 | Eberley et al. | 112/121.12 |
| 1,305,510 | 6/1919 | Wheeler | 112/121.11 |
| 1,669,785 | 5/1928 | Schmitt | 112/121.12 |
| 2,546,831 | 3/1951 | Newell | 112/121.11 |
| 3,496,891 | 2/1970 | Kosrow et al. | 112/304 |
| 4,141,304 | 2/1979 | Masuda | 112/153 |
| 4,226,197 | 10/1980 | Pollmeier et al. | 112/308 X |

*Primary Examiner*—H. Hampton Hunter
*Attorney, Agent, or Firm*—McGlew and Tuttle

[57] ABSTRACT

Two workpiece plies, placed on one another, of which the lower one is larger in width than the upper one, are to be sewn together with their edge contours aligned with each other. The device used for this purpose comprises a cutting mechanism provided ahead of the sewing machine in a workpiece feed direction, and following the contour of the upper work ply by means of guide unit for sensing this contour, so that the projecting portion of the work ply is cut off. To prevent the work plies from mutual displacement during their feeding toward the sewing machine, they are secured to each other by spot sealing at some locations wherefor a sealing tape is introduced between the plies.

10 Claims, 7 Drawing Figures

1
9
8
H
F
29
7
2
16
15
19
17
20
21
22
24
18
10
V
64
28
45
55
34
41
42
37
46
60
61
61
B
III
IV
49
K1
57
38
39
3
V
4
56
63
35
35
36
11
6
67
68
56
55
5
12
1
64
65 a
H
F
2
3
K1
b
5
6
c
d
70
71
K2
e
72
73

DEVICE FOR SEWING WORKPIECE PLIES TOGETHER IN CONTOUR ALIGNMENT

FIELD AND BACKGROUND OF THE INVENTION

The present invention relates in general to sewing fabrics together and, in particular to a new and useful device for sewing two workpiece plies together adjacent a contoured edge thereof.

To improve stability in the shape and comfort of trousers, the front parts of trousers are provided with a knee lining. This is done during the trimming of the longitudinal edges of the front parts of the trousers, by simultaneously sewing the lining piece or cut and securing the upper cut or piece of fabric with an overhead seam.

It is known, (German OS 2,747,792) to use sized lining cuts or pieces which register with the longitudinal edges of the upper fabric cuts. This requires the use of a number of lining pieces which are different in size and shape, to correspond to the variety of ready-made sizes and shapes of trousers.

Adequate care and time is needed for cutting the lining to sizes with exact contours. Another drawback is that the lining must be cut to size in an independent operation which is quite separate, in time and space, from the following sewing operation. This makes it also necessary to store both the upper fabric cuts and the lining cuts in the meantime, before the sewing operation. The time and space required therefor increase with the number of different ready-made sizes and designs.

To overcome these drawbacks, it has already been provided (German utility model 7,523,600) to replace contour-adjusted lining cuts with sized cuts of uniform width, for example rectangular ones, which fit the different sizes of the upper fabric cuts. During the sewing operation, the marginal portion of the lining cut, more or less protruding beyond the edge of the upper cut, is cut off by a cutting mechanism provided directly adjacent the stitch formation area of the sewing machine. To this end, the lining cut, along with the upper cut, must be advanced through the cutting area of the cutting mechanism in accordance with the contour of the upper cut. In such an operation, however, only the motion of the upper cut can be controlled by a contour controller. This control cannot be applied to the lining cut since the contour of the lining cut differs from that of the upper cut. Therefore, in such a case, the lining cut is not controlled in its advance, it is only taken along by frictional contact to follow the motion of the overlying upper cut which is moved laterally and rotated due to the contour control. Experience has shown however, that relative motions occur between the upper and lower cuts, which result in distortions of the lining cut and thus in an uneven and unsatisfactory product.

SUMMARY OF THE INVENTION

The invention is directed to a device of the above-mentioned kind with which lining cuts or pieces of uniform width can be sewn and the upper and lining cuts or pieces can be contour-controlled during the sewing operation without relative motion occurring between the pieces.

An object of the present invention is to provide a device for sewing two workpiece plies together, the plies having contoured and aligned edges, with the lower ply initially extending beyond the upper ply, the device using a sewing machine equipped with an automatic work guide and cutting mechanism, the device comprising a cutting mechanism provided upstream of the sewing machine work guide having a cutting tool mounted to follow the countour of the upper ply and cut the lower ply, means for sensing the contour of the upper ply and for controlling the movement of the cutting tool and, a feed mechanism for moving the workpiece plies into the work guide of the sewing machine.

Another object of the invention is to provide a fixing mechanism which functions to spot seal the two plies together after the lower ply is cut to the contour of the upper ply.

A further object of the invention is to provide such a device which is simple in design, rugged in construction and economical to manufacture.

Due to the provision of a step of fitting the contour of the lining piece to the contour of the upper piece by a lateral cutting in the zone of the seam to be made, which is in advance of the sewing operation, the starting pieces or initial parts of any design, for example, the lining pieces, can be used which are of uniform size and shape. As compared to the prior art method where the lining pieces are controlled in advance to fit the respective upper fabric cuts, in the invention, for example rectangular, lining pieces can be produced and used, in a much simpler way. Since after the contour-cutting the lining and upper cuts overlying one another are fed by the feed mechanism to the sewing machine, no intermediate storage of the cuts or pieces is necessary.

Because prior to the sewing operation, the lining piece is fitted to the upper fabric cut so that it has an exactly corresponding contour concurrent to the seam to be sewn, the motion of both cuts can be controlled during the sewing operation by the contour control with which the machine is equipped.

The invention further provides a fixing mechanism mounted between the cutting mechanism and the sewing machine, which is intended for substantially spot-sealing the two work plies or pieces to each other and which comprises a guide plate carrying auxiliary tape means for sealing the parts, which is introducable between the work plies. The fixing mechanism also includes a cutter for the tape means as well as a lowerable sealing head. By sealing them together, the work plies are prevented from being displaced relative to each other during their advance from the cutting area to the sewing machine and their introduction into the contour control apparatus.

According to a development of the invention and providing that the cutting mechanism is movable relative to the work plies in the longitudinal direction thereof, the fixing mechanism is mounted for following the motion of the cutting mechanism and for being stopped in the area of the leading edge of the ply to be cut, by stopping means.

If the work plies or pieces are front parts of trousers to be lined from the waistband to the knee area, and the lining piece is to be fitted to the upper fabric piece or cut on both longitudinal sides, the procedure calls for associating a trimming and a fixing mechanism with each of the longitudinal sides to be treated. The sewing is done on one side from the waistband to the hem and on the other side from the hem to the waistband. If the leading corner of the longitudinal side of the upper fabric piece to be sewn from the waistband to the hem is always placed at the same location of a supporting plate, so that the fixing point at which the two plies are to be connected to each other always occupies this constant position relative to the supporting plate, the stopping means of the associated fixing mechanism can be designed as a fixed mechanical stop. While cutting lining pieces which are of equal width but unequal length, depending on the ready-made size, and if sewing of the longitudinal side from the knee to the waistband is provided, the fixing point is located in the knee area of the upper fabric piece and, consequently, occupies different locations relative to the supporting plate. Then, it is advisable to equip, the stopping means of the fixing assembly associated with this longitudinal side, with a light barrier which senses the leading edge extending in the knee area of the upper fabric piece, and with a braking motor responsive thereto.

With the inventive device, the two longitudinal sides of the work or product can be treated sequentially, by performing the operations of cutting, fixing, feeding, and sewing first at one of the longitudinal sides and then the other. However, the two longitudinal sides may also be treated simultaneously if the operations of cutting and fixing are performed by two, and two oppositely mounted cutting and fixing devices working independently of each other are provided.

In the following, one embodiment of the invention is explained in more detail with reference to the drawings, but only with regard to mechanisms used for treating the longitudinal side of work plies to be sewn from the waistband to the hem.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
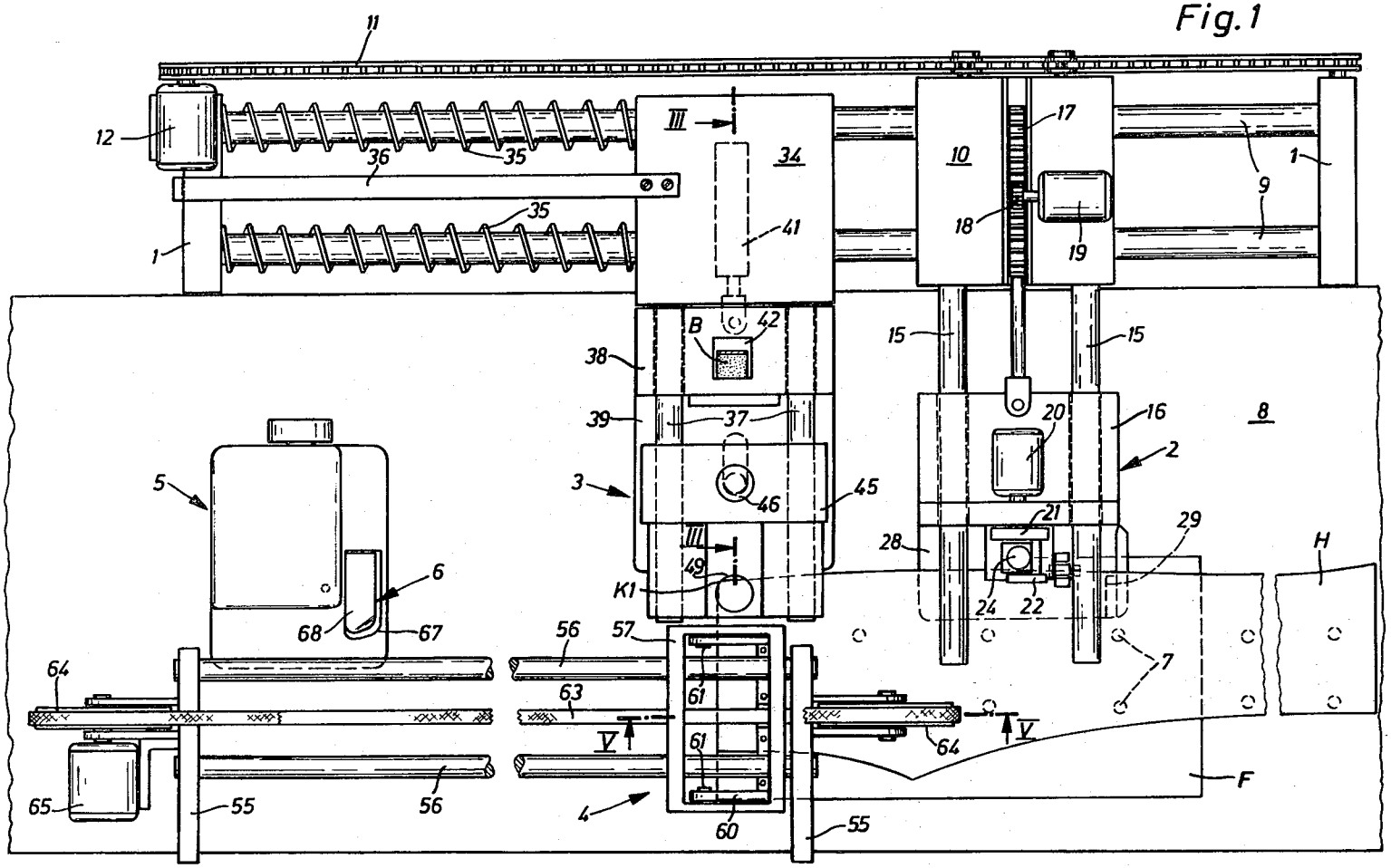
FIG. 1 is a top plan view of the cutting mechanism, fixing mechanism and feed mechanism as well as the sewing machine with a contour control apparatus according to the invention.

Referring to the drawings in particular, the invention embodied therein in FIG. 1, shows a device substantially comprising a frame 1, a cutting mechanism 2, a fixing mechanism 3, a feed mechanism 4, and an oversewing machine 5 with a contour control apparatus 6.

Figure 2:
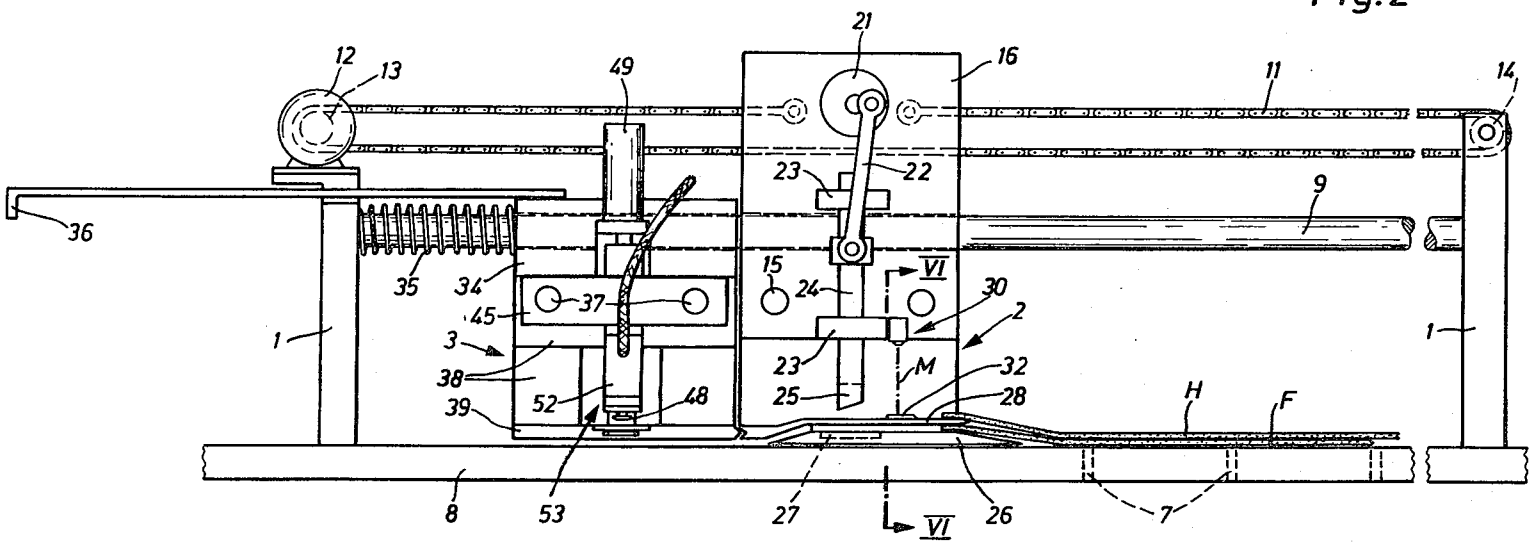
FIG. 2 is a side elevation of the cutting mechanism and the fixing mechanism of the invention.

Frame 1 comprises a supporting table 8 (see FIG. 2) which is provided with suction ports 7, and two parallel guide rods 9 extending above the table. Suction ports 7 are connected to a depression producing blower (not shown).

Cutting mechanism 2 comprises a carriage 10 (see FIG. 1), mounted for displacement on guide rods 9. Secured to carriage 10 are the two ends of a drive chain 11 which is driven by a motor 12 through a sprocket wheel 13 and trained around an idle sprocket wheel 14. Carriage 10 carries two parallel guide rods 15 which extend transversely to guide rods 9. A support 16 is mounted for displacement on guide rods 15. A gear rack 17 is secured to support 16 and displaceably mounted on carriage 10. A pinion 18 meshes with gear rack 17 and is driven by a motor 19 which is secured to carriage 10. Another motor 20 is secured to support 16 for driving a crank disc 21. A tie rod 22 is hinged or mounted to crank disc 21 and connected to a knife holder 24 which is guided in side guards 23. A cutting knife 25 with a circular cross section is secured to knife holder 24.

A horizontally extending plate 26 having beveled front and rear edges is placed on supporting table 8 and secured to support 16. A counterknife 27 cooperates with knife 25 is provided in plate 26. Another plate 28 is provided above plate 26, in a position slightly spaced therefrom. On its upper side, plate 28 is provided with an angular adjustment mark 29 (FIG. 1).

Motor 19 forms a part of a known light sensing guide system (not shown) having a light barrier 30 as its measuring element. Light barrier 30 comprises a light emitter 31 supported on the lower side guard 23, a mirror 32 which is adjustably supported on plate 28, and two phototransistors 33 as light receivers. Mirror 32 has a roof-like reflecting surface, so that the vertically incident light beams are reflected upwardly in two oppositely oblique directions. Due to this design, phototransistors 33 can be located at spaced apart positions, which eliminates erroneous sensing.

The lateral distance between cutting knife 25 and central line M of light barrier 30, which distance is to be measured in the direction of guide rods 9, can be adjusted by displacing light barrier 30.

Fixing mechanism 3 comprises a carriage 34 which is mounted for displacement on guide rods 9. For this purpose, compression springs 35 are provided on guide rods 9 between frame 1 and carriage 34. The distance of displacement of carriage 34 is limited by a stop 36 cooperating with frame 1. Carriage 34 carries two parallel guide rods 37 extending transversely to guide rods 9. Another carriage 38 is mounted for displacement on guide rods 37, and a horizontal guide plate 39 is supported on the lower end of the carriage. Carriage 38 is connected to the piston rod 40 (see FIG. 3) of an air cylinder 41 which is secured to carriage 34 and provided with a return spring (not shown). Guide plate 39 extends at substantially the same level as plate 28 of cutting mechanism 2. An elongated recess 42, extending parallel to guide rods 37, is provided in guide plate 39 and covered with a slightly shorter cover plate 43. Cover plate 43 is provided with an oblong slot 44.

A support 45 is fixed to the free end portions of guide rod 37. Above oblong slot 44, an air cylinder 46 provided with a return spring (not shown) is secured to support 45, and the downwardly extending piston rod 47 of this cylinder is equipped with a pressure element 48 which can pass through oblong slot 44. Another air cylinder 49 also provided with a return spring (not shown) and secured to support 45, comprises a downwardly extending piston rod 50 carrying a cutting and sealing tool 53 including a knife 51 and a sealing stamp 52. Knife 51 cooperates with a counterknife 54 which is secured to the front end of guide plate 39.

Figure 5:
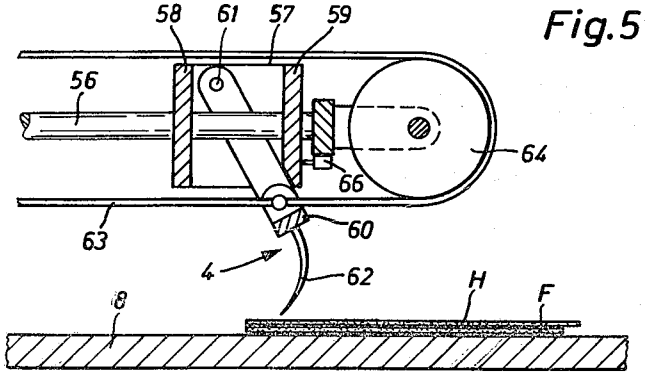
FIG. 5 is a partial sectional view of the feed mechanism taken along the line V—V of FIG. 1.

Feed mechanism 4 includes two vertical mounting plates 55 which are secured to frame 1 and support guide rods 56 extending parallel to guide rods 9. A frame 57 comprising a front stop plate 58 and a rear stop plate 59, is mounted for displacement on guide rods 56. Within frame 57, a U-shaped needle carrier 60 is hinged to the frame through pivot pins 61 which are provided close to front stop plate 58. A plurality of arcuate needles 62 are secured to needle carrier 60. With needle carrier 60 extending vertically, the needle points are positioned closely above supporting table 8. An endless belt or the like, 63 is passed around two tail pulleys 64 and attached to the lower end of the needle carrier 60. One of pulleys 64 is connected to a reversible stop motor 65. Limit switches 66, one of which is shown in FIG. 5, are provided within the range of frame 57 and operate to switch off stop motor 65.

In a manner known per se, the contour control 6 shown in FIG. 1 comprises a lower plate 67 and an upper swing-up plate 68. A pressure point (not shown) is provided on each of the surfaces of plates 67 and 68 which face each other.

The device operates as follows:

At the start of a working cycle, cutting mechanism 2 and fixing mechanism 3 are in initial positions at the left end of guide rods 9, that is to the left of their positions in FIG. 1. In this position, support 16 occupies a central position on guide rods 15, which is determined by the guide mechanism. Carriage 38 with guide plate 39 is in its extended position. A fixing tape B as the auxiliary sealing means is introduced from a suppy wheel (not shown) into recess 42, up to counterknife 54. Feed mechanism 4 is retracted into an ineffective position in which needles 62 are lifted.

Figure 6:
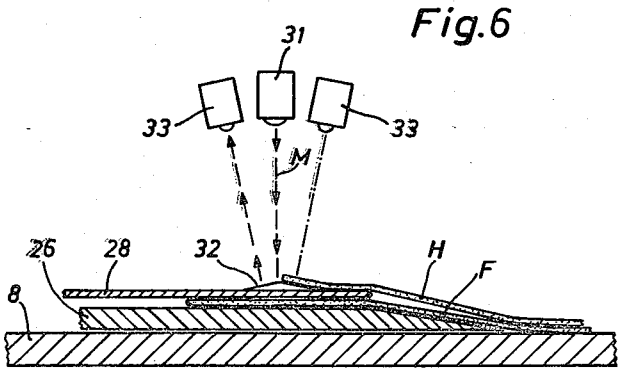
FIG. 6 is a partial sectional view of the cutting mechanism in the zone of the light barrier, taken along the line VI—VI of FIG. 2.

The two workpiece plies to be connected to each other, namely the upper fabric cut or piece H and the rectangular lining cut or piece F, are placed together on supporting table 8, with the edge of lining cut F which extends in the waistband area being introduced between plates 26, 28 and the corresponding edge K1 of upper fabric cut H being placed on upper plate 28 and adjusted in longitudinal and transverse directions to mark 29. The position of edge K1 of the longitudinal side of upper fabric cut H to be treated, is thereby exactly fixed under any circumstances, since while putting the work plies in place, cutting mechanism 2 including support 16, always occupies the same initial position. Further, mark 29 is provided at such a location that edge K1 of the longitudinal side of upper fabric cut H to be treated, is contiguous to central line M of light barrier 30, and the right half of mirror 32 is covered, as shown in FIG. 6. Upon positioning work plies H and F and switching on the blower which produces a suction pressure in suction ports 7, cutting mechanism 2 is set in operation, so that motor 12 displaces carriage 10 through drive chain 11 on guide rods 9 at a uniform speed to the right as seen in FIG. 1. Simultaneously with motor 12, motor 20 driving cutting knife 25 is switched on so that the lateral portion of lining cut F starts to being cut off. As long as the longitudinal edge of upper fabric cut H sensed by means of light barrier 30 continues to extend parallel to guide rods 9, and mirror 32 remains one half covered, motor 19 remains stopped, so that support 16 with light barrier 30, cutting knife 25, and counterknife 27, remains in its initial central position on guide rods 15. However, as soon as the longitudinal edge of the upper fabric cut starts extending obliquely or in an arc so that mirror 32 is no longer covered by one half its area but is covered more or less, phototransistors 33 in connection with a conventional and therefore not further explained control circuit, respond to the effect that motor 19, through pinion 18 and gear rack 17, displaces support 16 on guide rods 15 to follow the contour of the upper fabric cut H until mirror 32 is again one half covered. Since thereby not only the running direction but also the speed of motor 19 is controlled as a function of the deviation of the sensed longitudinal edge of cut H from the central line of mirror 32, support 16 is caused to exactly follow also a curvature reversal of the contour of cut H. In this way, the lining cut F is cut to exactly correspond to the contour of upper fabric cut H.

Depending on the adjustment of light barrier 30, lining F can be cut to be in register with, or to have a constant margin relative to, the upper ply H.

During the motion of cutting mechanism 2 from its initial position, compression springs 35 cause fixing mechanisms 3 to follow cutting mechanism 2 until stop 36 abuts frame 1 (the position of mechanism 3 in FIG. 1). In the course of this motion, guide plate 39 which is in extended position and applies by its front edge against the rear edge of plate 28, penetrates between the two work plies F and H. In the stopped position of fixing mechanism 3 determined by stop 36 and shown in FIG. 1, guide plate 39 has penetrated between work plies H and F, so far that the edge of the side facing the sewing machine 5 of fixing tape B is in register with the front edge K1 of upper fabric cut H.

Figure 3:
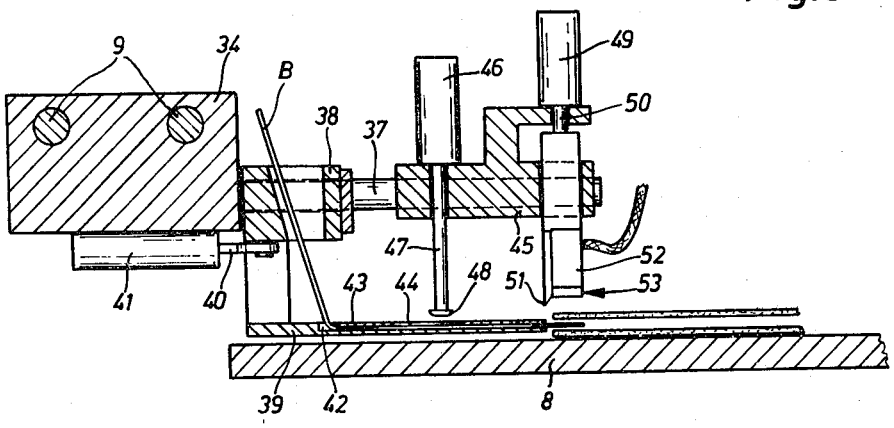
FIG. 3 is a sectional view of the fixing mechanism taken along the line III—III of FIG. 1.
Figure 4:
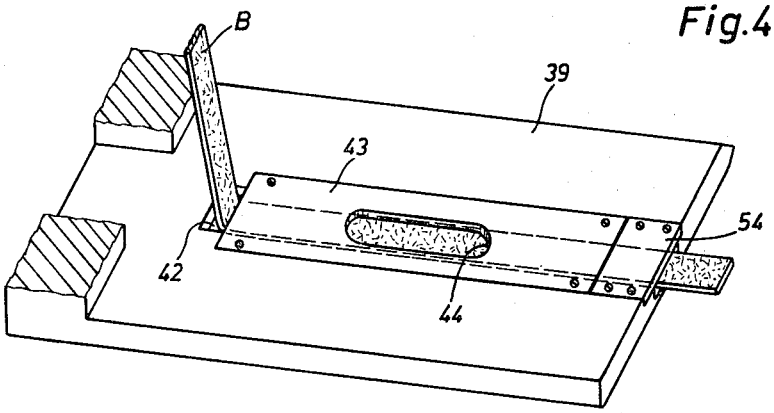
FIG. 4 is a perspective view of the guide plate of the fixing mechanism.

Upon stopping fixing mechanisms 3, air is admitted to air cylinder 46 so that pressure element 48 is lowered through oblong slot 44 to fixing tape B. Then, air cylinder 41 secured to carriage 38 is vented to retract guide plate 39 from between work plies F and H. Since pressure element 48 holds tape B in place, a portion of fixing tape B previously introduced between work plies H and F, as shown in FIG. 3, remains between the plies. After a full retraction of guide plate 39, air is admitted to air cylinder 49 whereby cutting and sealing tool 53 is lowered. The portion of fixing tape B extending between work plies H and F is thus cut off and heat-sealed to the two plies H and F under the effect of sealing stamp 52. This is substantially a spot sealing of the two work plies H and F to each other at the leading ends of their longitudinal sides to be sewn.

As soon as the cutting of lining F is terminated, stop motor 65 of feed mechanism 4 is switched on, so that the lower section of endless belt 63 causes pivoting of needle carrier 60 upwardly, about pivot pins 61 as shown in FIG. 5. Only after needle carrier 60 butts against stop plate 59, the motion of belt 63 is transmitted to frame 57 to move the frame on guide rods 56 in the direction of work plies F and H. During this motion, needles 62 remain sufficiently lifted so that they do not contact plies F and H. After needles 62 have passed beyond the leading edge of upper fabric cut H, frame 57 actuates a limit switch 66 to reverse the run of stop motor 63. The first effect of this reversal is that needle carrier 60 is pivoted downwardly by belt 63, and the points of needles 62 penetrate into work plies F and H. Then, as needle carrier 60 butts against stop plate 58, belt 63 takes frame 57 along too and moves it in the direction of sewing machine 5. In this way, with the suction air now switched off, work plies F and H are together fed over supporting table 8 to the sewing machine 5, from a position a into a position b as shown in FIG. 7.

Since, after the cutting operation, lining cut F has a contour corresponding to that of upper fabric cut H, both work plies F and H can be guided conjointly in a guide slot of contour control apparatus 6. With plate 68 lifted, feed mechanism 4 moves the leading edges of the plies F and H overlying each other through contour control apparatus 6 to sewing machine 5. Plate 68 is then lowered again and sewing machine 5 is set in operation to connect the two workplies F and H together along their entire length and to trim their edges. The contour control apparatus 6 insures that during this operation the seam continues to run parallel to the two longitudinal edges.

During the sewing operation and with cutting and fixing mechanisms 2 and 3 again in their initial positions, two new work plies F and H are placed on supporting table 8 for the next cutting operation.

Figure 7:
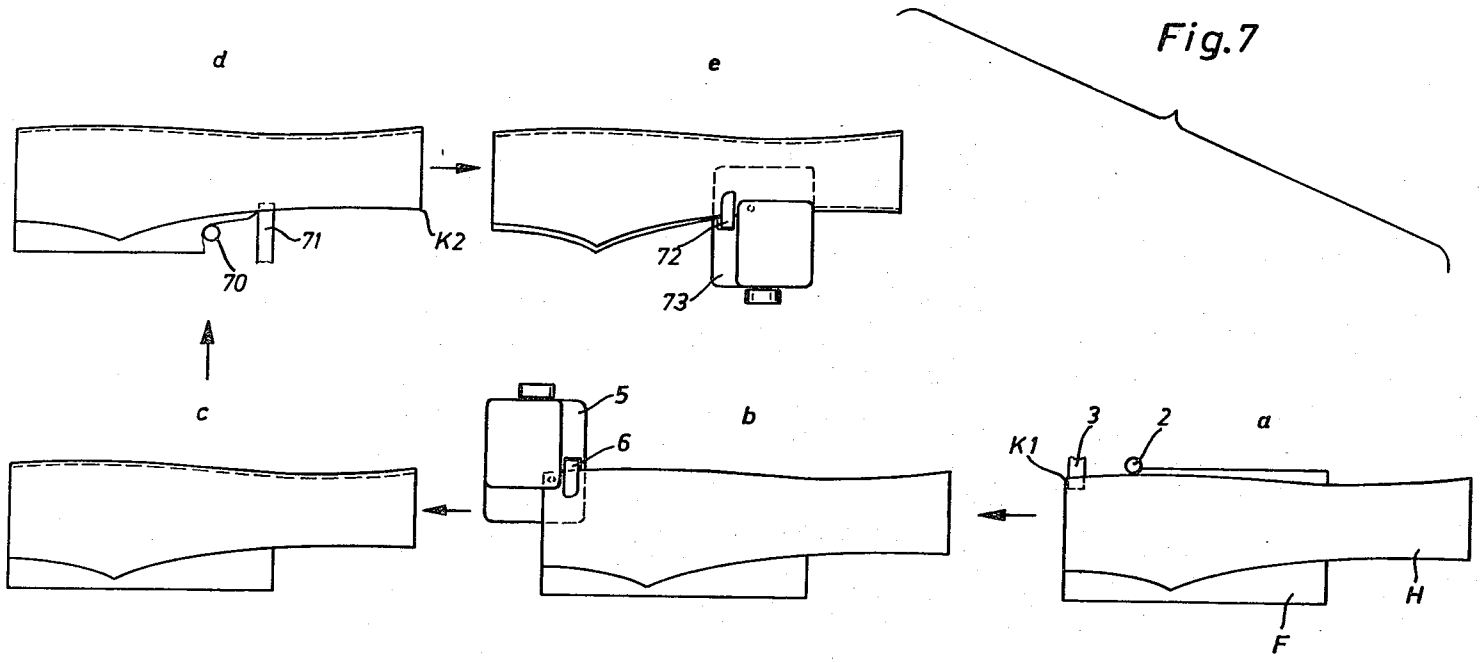
FIG. 7 is a diagrammatical showing the different working phases of the invention, during the treatment of both longitudinal sides of two work plies.

After work plies F and H are sewn together, they are brought from a position c of FIG. 7 into a position d by means of conventional and therefore not further described conveying means, to position edge K2 of upper fabric cut H at a definite, always the same, location of supporting table 8, for example with the aid of a light barrier control. Then the other, not yet treated longitudinal sides of work plies F and H undergo the cutting operation in a cutting mechanism 70 and the plies F and H are secured to each other in a fixing mechanism 71. Cutting mechanism 70 and fixing mechanism 71 are substantially of the same design as cutting mechanism 2 and fixing mechanism 3 respectively, so that there is no need for a separate description.

Since lining cut F extends only to the knee zone, thus only to about the middle of upper fabric cut H and, consequently, in this direction of treatment, the leading edge of ply F extending in the knee zone will be differently spaced from the leading edge K2 of the upper ply H due to the different ready-made sizes, no mechanical stop can be used for stopping fixing mechanism 71. Fixing mechanism 71 is therefore equipped with a conventional and not further explained light barrier control for detecting the leading edge of lining cut F during the motion of fixing mechanism 71 and stopping the assembly at the location where the two work plies F and H are to be sealed to each other.

In positions d, and e, shown in FIG. 7, in which the other longitudinal sides of work plies F and H are treated, lining F is cut with a lateral margin relative to upper ply H, to be able, in the following sewing operation, to sew the lining cut F to upper fabric H with an excess in width. To this end, prior to the sealing operation, the protruding marginal strip of lining F must be shifted in the zone of the leading edge to be in register with the edge of upper fabric cut H. During the sewing operation, the protruding marginal strip is shifted by contour control apparatus 72 into congruance with the contour of upper fabric cut H, so that in this instance again, the longitudinal sides of the two work plies F and H are sewn to each other in correct alignment.

While a specific embodiment of the invention has been shown and described in detail to illustrate the application of the principles of the invention, it will be understood that the invention may be embodied otherwise without departing from such principles.

What is claimed is:

1. A device for sewing upper and lower workpiece plies together adjacent contoured substantially aligned edges thereof in a sewing machine having automatic workpiece guide means for sewing along a contour as the plies are fed in a sewing direction, the lower workpiece ply initially extending beyond the contoured edge of the upper workpiece ply, comprising:

a cutting mechanism positioned upstream of the sewing machine workpiece guide means in the sewing direction, having a movable cutting tool for cutting a portion of the lower workpiece ply extending beyond the contoured edge of the upper workpiece ply, said cutting mechanism including means for sensing the contoured edge of the upper ply and means for moving the cutting tool in response to said sensing means to follow the contoured edge of the upper ply; and a feed mechanism positioned between said cutting mechanism and the sewing machine workpiece guide for moving the workpiece plies together into the sewing machine workpiece guide means.

2. A device according to claim 1, including a fixing mechanism positioned between said cutting mechanism and the sewing machine workpiece guide means for substantially spot-sealing the two workpiece plies together, said fixing mechanism comprising a guide plate for engagement between the workpiece plies, sealing tape means for supplying sealing tape between the workpiece plies separated by said guide plate, and means for cutting a length of tape supplied by said sealing tape means and sealing the length of tape between the two workpiece plies.

3. A device according to claim 2, wherein said cutting mechanism is mounted for movement longitudinally of the sewing direction, said fixing mechanism being mounted for movement to at least partially follow movement of said cutting mechanism and including a stop member for stopping the following movement of said fixing mechanism at a position to bring said fixing mechanism substantially into the area of a leading edge of the workpiece plies in the sewing direction.

4. A device according to claim 2, including at least one guide rod extending substantially in the sewing direction, a first carriage movably mounted on said guide rod, at least one second guide rod extending from said first carriage substantially perpendicularly to said first mentioned guide rod, a cutting mechanism carriage slidably mounted on said second guide rod, and drive means connected between said first carriage and said cutting mechanism carriage for moving said cutting mechanism carriage substantially transversely to the sewing direction.

5. A device according to claim 4, wherein said cutting tool is movably mounted on said cutting mechanism carriage for reciprocal substantially vertical movement, said means for moving said cutting tool including said drive means connected between said first carriage and said cutting mechanism carriage and additional drive means connected to said first carriage for moving said first carriage along said first mentioned guide rod.

6. A device according to claim 1, wherein said means for sensing the contoured edge of the upper ply comprises a light transmitter, a reflecting surface and at least two light receivers, said reflecting surface having a pair of inclined surfaces for directing light from said light transmitter to each of said light receivers when said surfaces are uncovered, said reflecting surfaces mounted on a separating plate of said cutting mechanism positionable between the two workpiece plies, one of said inclined surfaces being adapted to be covered by a portion of the upper workpiece ply, said sensing means operable to activate said means for moving the cutting tool when the portion of the upper workpiece ply covers more or less than said one inclined surface.

7. A device according to claim 4, wherein said fixing mechanism comprises a second carriage slidably mounted on said first mentioned guide rod, at least one third guide rod extending from said second carriage substantially perpendicularly to said first mentioned guide rod, said tape means comprising a tape carriage slidably mounted on said third guide rod and drive means between said second carriage and said tape means carriage for moving said tape means carriage on said third guide rod, said tape means carriage including a recess for tape, means for extending tape from an edge of said recess into a space between the two workpiece supplies, said drive means for moving said tape means carriage operable to withdraw said tape means carriage after tape is cut and sealed by said tape cutting and sealing means.

8. A device according to claim 7, including a support member connected to said third guide rod for carrying said tape cutting and sealing means, a pressure element movably mounted on said support and movable to engage tape carried by said tape means carriage and hold the tape from movement when said tape means carriage is moved.

9. A device according to claim 1, wherein said feed mechanism comprises a frame, at least one needle carrier pivotable between a raised and lowered position on said frame, a workpiece ply engaging needle extending from said needle carrier engaged with the workpiece plies in said lowered position of said needle carrier and disengaged from the workpiece plies in said raised position of said needle carrier, and drive means connected to said needle carrier for movement in one direction to pivot said needle carrier into its lowered position and simultaneously move the workpiece plies in the sewing direction and, in an opposite direction, to raise said needle carrier into its raised position and move said frame into an initial position for receiving additional workpiece plies.

10. A device according to claim 4, including a biasing spring engaged on said first mentioned guide rod and urging said fixing mechanism toward said cutting mechanism.

* * * * *